US007195252B1

(12) United States Patent
Glosky

(10) Patent No.: US 7,195,252 B1
(45) Date of Patent: Mar. 27, 2007

(54) KIT FOR MODIFYING AN INLINE SKATE TO ROLL IN ONE DIRECTION ONLY

(76) Inventor: Daniel Glosky, 308 Ottawa Dr., Bolingbrook, IL (US) 60440-1888

( * ) Notice: Subject to any disclaimer, the term of this patent is extended or adjusted under 35 U.S.C. 154(b) by 240 days.

(21) Appl. No.: 10/839,575

(22) Filed: May 5, 2004

Related U.S. Application Data

(60) Provisional application No. 60/468,592, filed on May 7, 2003.

(51) Int. Cl.
*A63C 17/14* (2006.01)

(52) U.S. Cl. ..... 280/11.201; 280/11.223

(58) Field of Classification Search ..... 280/11.201, 280/11.204, 11.223, 11.231; 188/82.2, 82.3, 188/82.4; 310/5.301
See application file for complete search history.

(56) References Cited

U.S. PATENT DOCUMENTS

| | | | | |
|---|---|---|---|---|
| 1,173,343 A | | 2/1916 | Deacon | |
| 3,392,986 A | | 7/1968 | Ryan | |
| 3,790,187 A | | 2/1974 | Radu | |
| 3,871,672 A | | 3/1975 | Bardy | |
| 4,194,751 A | | 3/1980 | Shinmura | |
| 4,289,323 A | | 9/1981 | Roberts | |
| 4,334,690 A | * | 6/1982 | Klamer et al. | 280/11.201 |
| 4,410,195 A | | 10/1983 | Agustin | |
| 4,526,389 A | | 7/1985 | Chase | |
| 4,553,767 A | | 11/1985 | Robjent | |
| 4,932,676 A | | 6/1990 | Klamer | |
| 5,374,072 A | * | 12/1994 | Landers | 280/11.27 |
| 5,527,050 A | * | 6/1996 | Szendel | 280/11.223 |
| 5,620,190 A | * | 4/1997 | Maggiore | 280/11.201 |
| 5,709,395 A | | 1/1998 | Lee | |
| 5,873,583 A | * | 2/1999 | Moore | 280/11.201 |
| 5,954,348 A | | 9/1999 | Santarsiero | |
| 6,082,746 A | * | 7/2000 | Wrike | 280/11.223 |
| 6,170,837 B1 | * | 1/2001 | Ross | 280/1 |

* cited by examiner

*Primary Examiner*—Christopher Bottorff
(74) *Attorney, Agent, or Firm*—Robert L. Marsh

(57) ABSTRACT

A kit for modifying an in line skate to role in one direction only consists of locking plate having a rectangular central hole an a shoulder along one edge, a tubular sleeve having a rectangular head sized to non-rotatably fit within the central hole of the plate, and a wheel with a built in one way clutch with a central opening sized to receive the tubular sleeve.

5 Claims, 3 Drawing Sheets

KIT FOR MODIFYING AN INLINE SKATE TO ROLL IN ONE DIRECTION ONLY

The applicant claims priority from his provisional application filed May 7, 2003 and assigned Ser. No. 60/468,592. The present invention relates to inline skates and to a kit for modifying an inline skate to prevent it from rolling backwards during use.

BACKGROUND OF THE INVENTION

Inline skates have substantially replaced the box configuration of skate wheels on what were previously known as "roller skates." Although the skates allow an experienced user to efficiently roll across a paved surface such as a sidewalk or a street, novices, especially children, are susceptible to falling because of the ease with which the wheels roll. For most purposes, the skates are needed to roll only in the forward direction and only experienced skaters have a need for skates with wheels, which roll rearwardly. Nonetheless, the wheels of inline skates are adapted for either forward or rearward movement. It would be desirable, therefore, to provide a kit for modifying an existing inline skate to enable the skate to roll in the forward direction only.

SUMMARY OF THE INVENTION

Briefly, the present invention is embodied in a kit for modifying inline skates of the type having a shoe with first and second parallel frame members attached to the shoe. Extending between the frame member are a plurality of axles with each of the axles having a wheel rotatably fitted thereon.

The kit consists of a tubular sleeve having a central opening with a diameter sufficiently large to receive an axle of the skate and having at one end of the sleeve a square head having parallel opposing outer edges. The kit further includes a locking plate having an aperture therein having parallel spaced inner edges complementary to the parallel outer edges of the head of the tubular sleeve and the plate further has a shoulder for engaging a lower surface of one of the frame members of the skate. Finally, the kit includes a wheel having a one-way clutch therein, the one-way clutch having a central inner opening sized to engage the outer circumference of the sleeve described above.

In accordance with the invention, one of the axles retaining the wheels of the skate is removed thereby allowing removal of one of the wheels of the skate. Thereafter, the tubular shaft of the kit is inserted into the central opening of the one-way clutch in the replacement wheel and the parallel outer edges of the head of the tubular sleeve are fitted between the parallel inner edges of the aperture in the locking plate. The locking plate with the sleeve and wheel assembled thereto are thereafter fitted between the parallel frame members of the skate and aligned with the apertures therein from which the axle was removed. The axle is thereafter reinserted through the apertures in the frame members and through the central opening of the sleeve thereby retaining the replacement wheel with the one-way clutch between the frame members of the skate and retaining the shoulder of the locking member against a lower edge of one of the frame members of the skate. After the parts are assembled, the shoulder of the locking member will engage the lower edge of the skate and prevent rotation of the tubular sleeve within the opening of the one-way clutch. The one-way clutch will permit the replacement wheel to roll in one direction only. The proper assembly requires that the wheel, the tubular sleeve, and locking plate be assembled to allow the wheel to roll only in the forward direction only.

The method of the invention therefore includes the steps of removing one of the existing axles from the aligned holes in the frame members of a skate to thereby remove one of the wheels thereof. Thereafter, providing a tubular sleeve having an inner opening and a head at one end thereof, with the head having parallel outer edges. Providing a locking plate having an aperture therein, having parallel inner edges complementary to the parallel outer edges of the head of the tubular sleeve, and having a shoulder for engaging a lower edge of one of the frame members.

To carry out the method of the invention, the parts are assembled with the parallel outer edges of the head of the sleeve fitted between the parallel inner edges of the locking plate and the central opening of the replacement wheel fitted around the outer circumference of the tubular sleeve. The assembled parts are thereafter fitted between the parallel frame members of the skate with the central opening of the tubular sleeve aligned with the opposing aligned holes from which the shaft was removed. The axle is thereafter inserted through the aligned holes and through the central opening of the sleeve to retain the parts together between the frame members of the skate and to retain the shoulder of the locking member against the lower edge of one of the frame members of the skate.

In an alternate embodiment of the invention, an elongate locking plate is provided having a length longer than the distance between two adjacent axles of the skate. The plate has two apertures therein with the spacing between the apertures equal to the spacing between two adjacent axles of the skate. One of the two apertures on the plate has a pair of spaced inner edges complementary to the outer edges of the head of the tubular sleeve.

The method of assembly of the parts of this embodiment requires that the axles of two adjacent wheels be removed. Although the axles of two wheels are removed, only one of the wheels is replaced with a replacement wheel having a one-way clutch and the tubular sleeve previously described. As in the first embodiment, the tubular sleeve is fitted through the central opening of the one-way clutch of the replacement wheel and the parallel opposing edges of the head are fitted between the parallel opposing inner edges of the locking plate. The parts are then fitted between the parallel frame members of the skate with the second hole of the locking plate aligned to receive the axle of the removed adjacent wheel. Both axles are thereafter replaced with one of the axles extending through the central opening of the tubular sleeve for retaining the sleeve, the locking plate, and the replacement wheel with one-way clutch. The second axle retains the original wheel and extending through the second hole in the locking plate to thereby prevent rotation of the locking plate.

BRIEF DESCRIPTION OF THE DRAWINGS

A better understanding of the present invention will be had after a reading of the following detailed description taken in conjunction with the drawings, wherein.

DETAILED DESCRIPTION OF A PREFERRED EMBODIMENT

Figure 1:
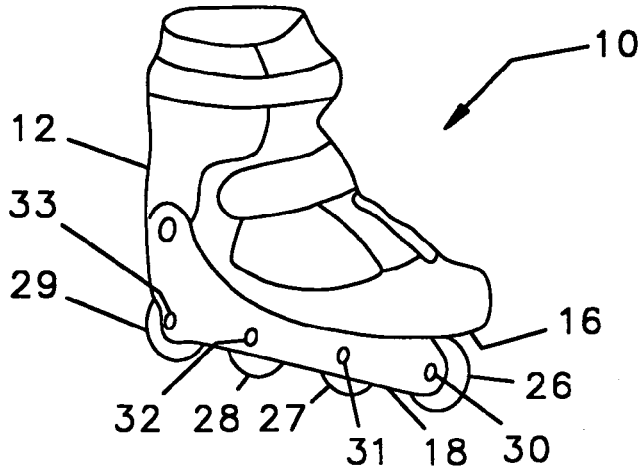
FIG.1 PRIOR ART
FIG. 1 is an isometric view of an inline skate.
Figure 2:
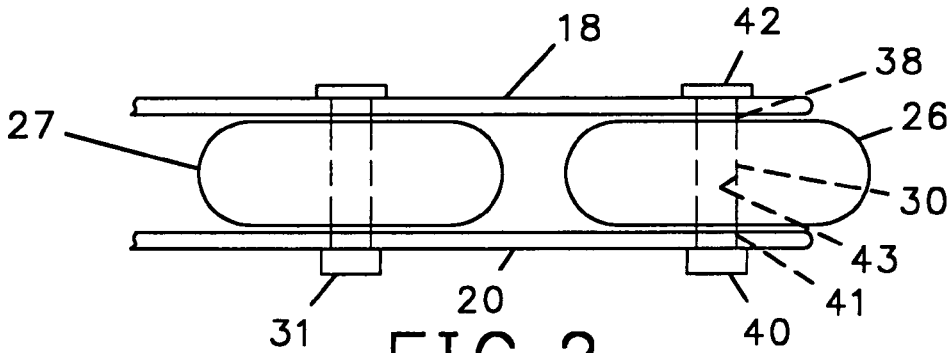
FIG.2 PRIOR ART
FIG. 2 is a fragmentary enlarged bottom view of the skate shown in FIG. 1 and showing in broken lines an axle for retaining one of the wheels thereto.
Figure 3:
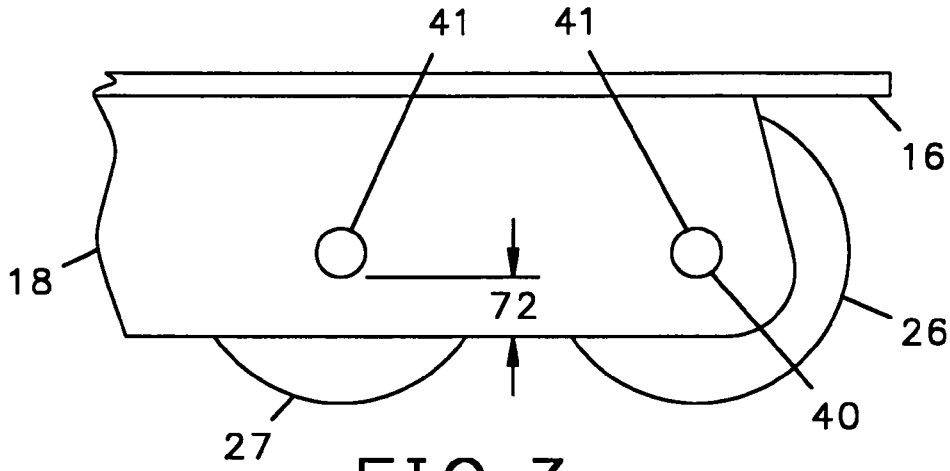
FIG.3 PRIOR ART
FIG. 3 is a fragmentary enlarged side elevational view of the skate shown in FIG. 1.

Referring to FIGS. 1, 2, and 3 an inline skate 10 consists of a boot 12 having a metal plate 16 attached to the sole thereof. Extending downward from the lower surface of the plate 16 are a pair of spaced frame members 18, 20 having elongate lower edges 22, 24. Spaced between the frame members 18, 20 are a plurality of wheels 26, 27, 28, 29, each of which is rotatably mounted on an associated axle bolt 30, 31, 32, 33, the outer ends of which are received in complementary holes in the frame members 18, 20. The wheels 26–29 are rotatable in either direction about their associated axes 30–33 to allow the skate 10 roll forwardly and rearwardly on a hard planar surface such as a sidewalk or a street.

Referring to FIGS. 2 and 3, axle bolt 30 of wheel 26 consists of an elongate stud 36 having a threaded portion 38 at the distal end thereof and an enlarged head 40 having a hexagon indentation at the end thereof, not shown, for receiving an Allen wrench. The bolt 30 extends through a hole 41 in one frame member 18, through a transverse hole 43 in the wheel 26, and the threaded distal end 38 of the bolt 30 is threaded into complementary threads, not shown, in the hole 42 in one of the frame members 20. A wheel 26 may therefore be removed from the skate 10 by unthreading the bolt 30 from the threaded hole 42 and removing it from the central opening of the wheel 26, thereby allowing the wheel 26 to be removed from between the frame members 18, 20.

Figure 4:
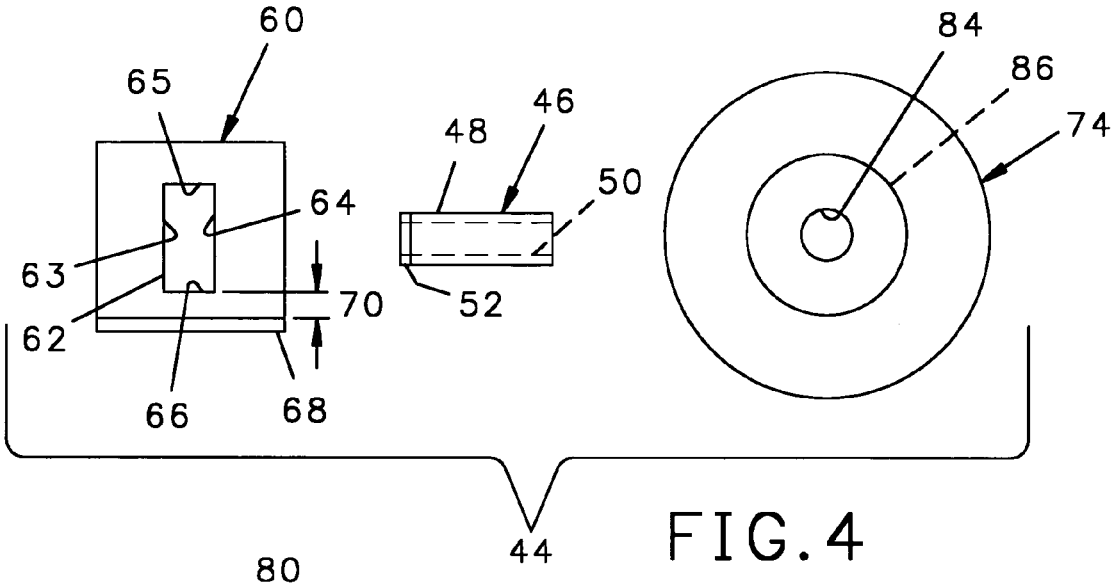
FIG. 4 is a side elevational view of the parts of a kit in accordance with the present invention for modifying the skate of FIG. 1 to roll in one direction only.
Figure 5:
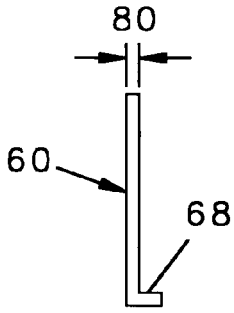
FIG. 5 is a side view of the locking plate shown in FIG. 4.
Figure 6:
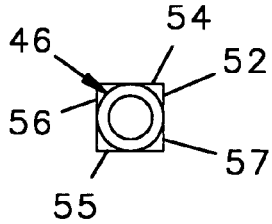
FIG. 6 is an end view of the sleeve shown in FIG. 4.

Referring to FIGS. 4, 5 and 6, a kit 44 to modify the skate 10 so as to permit movement in the forward direction only consists of a tubular sleeve 46 having an outer surface 48, a central opening 50, and an enlarged square shaped head 52 having first opposing parallel surfaces 54, 55 and second opposing parallel surfaces 56, 57. The kit further includes a generally rectangularly shaped metal locking plate 60 having a rectangular hole 62 therein having inner surfaces 63, 64, 65, 66 the dimensions of which are sized to slideably receive the sides 54, 55, 56, 57 of the square head 52 of sleeve 46. The locking plate 60 further has a shoulder 68 spaced from the nearest edge 66 of the hole 62 a distance 70 that is no greater than the distance 72 from nearest edge of one of the holes 41 in frame member 18 to the lower edge 24 of frame member 18 as shown in FIGS. 1 and 3.

The kit 44 further includes a replacement wheel 74 the diameter of which is equal to the diameter of the other wheels 26–29 of the skate 10 and having a cross-sectional width 78, which when added to the thickness 80 of the plate 60 equals the thickness 82 of the original wheels 26–29 which is replaced by the parts of the kit 44. The replacement wheel 74 has a transverse central opening 84, the diameter of which is sized to receive the outer surface 48 of the tubular sleeve 46. The replacement wheel 74 also has therein a one-way clutch 86 of the type known in the art for permitting rotation of the replacement wheel in one direction only. Many forms of one-way clutches are suitable for incorporation in the replacement wheel 74 are known in the art, any of which may be incorporated as the one-way clutch 86 in the replacement wheel 74.

Figure 7:
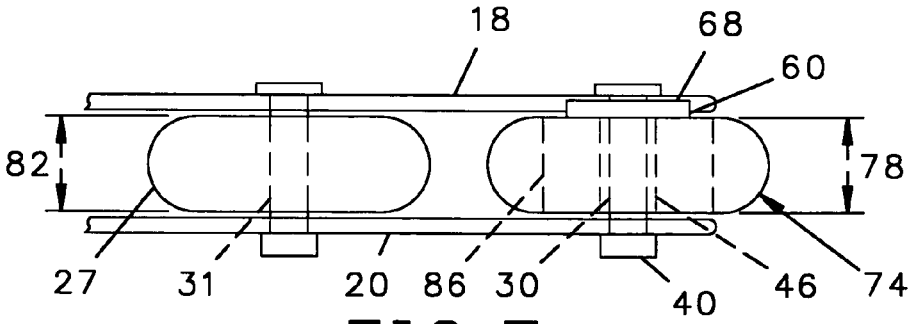
FIG. 7 is a bottom view of the skate shown in FIG. 1 with the parts of the kit shown in FIG. 4 installed therein.
Figure 8:
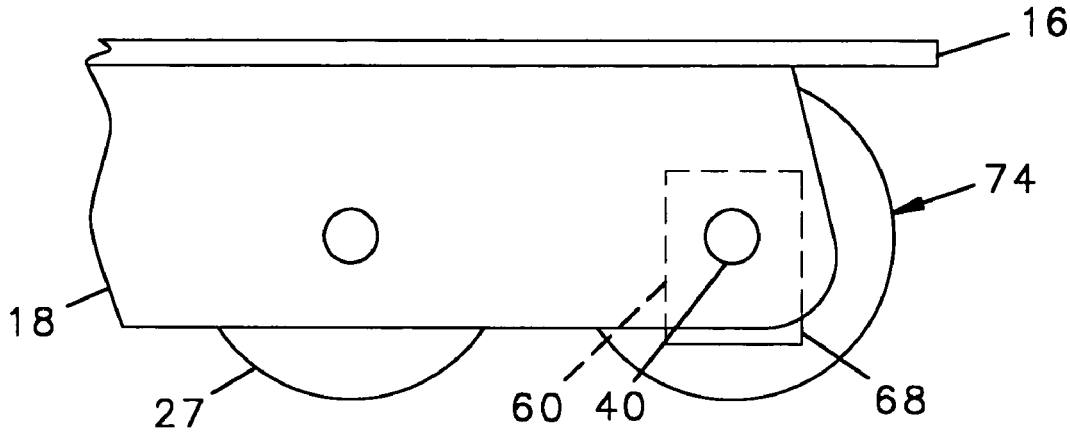
FIG. 8 is a side elevational view of the skate shown in FIG. 7.

Referring to FIGS. 7 and 8, to assemble the parts of the kit 44 into the skate 10, the tubular sleeve 46 is extended through the central opening 84 of the replacement wheel 74 until further insertion is prevented by the head 52 contacting the side surface of the replacement wheel 74. The locking plate 60 is then assembled to the head 52 by inserting the head 52 into the complementarily shaped rectangular hole 62 therein with the shoulder 68 extending axially outward of the wheel 74. Care should be taken to assemble the replacement wheel 74 on the sleeve 46 so that on completion, the replacement wheel 74 will roll forwardly rather than rearwardly. Reversing the wheel on the tubular sleeve 46 will reverse the direction in which the replacement wheel 74 will roll.

Once the parts are assembled to each other, the tubular sleeve 46 with the locking plate 60 and replacement wheel 74 assembled thereto are fitted between the frame members 18, 20 with the central opening 50 of the tubular sleeve aligned with the holes 41, 42 in the frame members 18, 20 respectively. When aligned in this fashion, the shoulder 68 of locking plate 60 should engage the lower edge 24 of frame member 18. Thereafter, the axle bolt 30 is inserted through hole 41 in frame member 18, through the interior 50 of the tubular sleeve 46, and threaded into the threaded hole 42 in frame member 20.

Once the bolt 30 has been tightened into place, the skate 10 is ready for use. Since the replacement wheel 74 can rotate in one direction only, with the direction of rotation permitting forward motion of the skate 10, a user of skate 10 can skate only in a forwardly direction.

Figure 9:
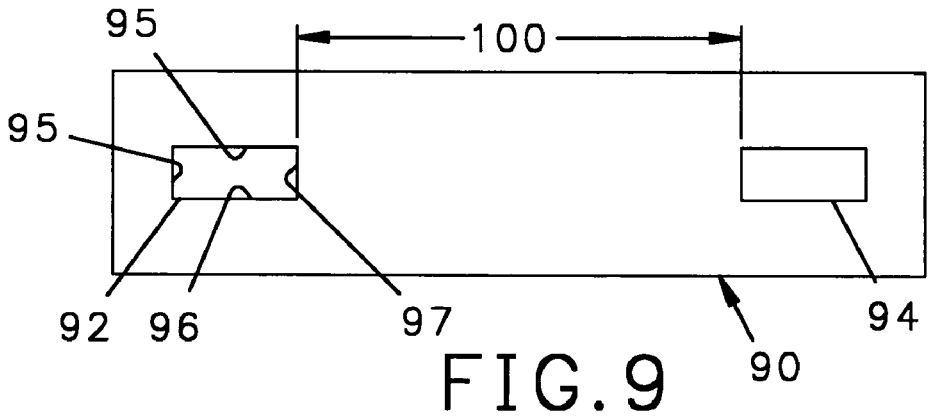
FIG. 9 is a side elevational view of a second embodiment of a locking plate for use with the remaining parts of the kit as shown in FIG. 4.
Figure 10:
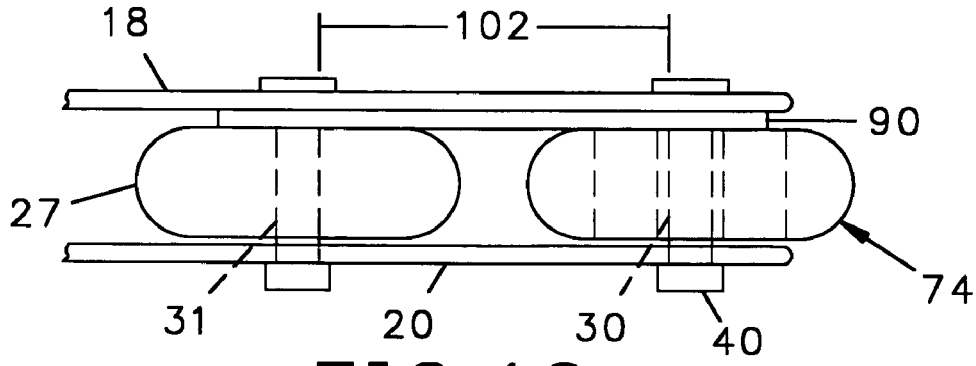
FIG. 10 is a bottom view of the skate shown in FIG. 1 with the parts of the invention installed therein where the locking plate of FIG. 9 has been substituted for the locking plate of FIG. 4.

Referring to FIGS. 9 and 10, in a second embodiment of the invention, the locking plate 60 may be replaced by an alternate locking plate 90. Locking plate 90 is an elongate member having two holes 92, 94 therein at least one of which is rectangular, having inner edges 95, 96, 97, 98 sized to slideably receive the head 52 of the tubular sleeve 46. The second hole, although depicted as being square, can be any shape to slideably receive the shaft of another axle bolt 31. The holes 92, 94 are spaced apart from each other by a distance 100 which is equal to or less than the distance 102 between adjacent parallel axles 30, 31 of the skate 10.

In this embodiment the tubular sleeve 46 is inserted into the central opening 84 of the wheel 74 until the head 52 abuts one side of the replacement wheel 74 as has been previously described. Thereafter, the locking plate 90 is assembled to the tubular sleeve 46 by inserting the square head 52 into the complementarily shaped square hole 92 of the locking plate 90.

To assemble a kit incorporating the second embodiment of the locking plate 90, the axles 30, 31 of two wheels 26, 27 must be removed from the skate 10, although only one of the wheels 26 is entirely replaced. In this embodiment, the parts consist of the sleeve 46, the replacement wheel 74, and locking plate 90. The assembled parts are positioned between the parallel frame members 18, 20 and the axle bolt 30 is reinserted through hole 41, the inner opening 50 of the tubular sleeve 46, and threaded into opening 42 as previously described. Thereafter, the axle bolt 31 is reinserted into the holes from which it was previously withdrawn and through the second hole 94 of locking plate 90 thereby preventing the rotation of the locking plate 90 about the hole 92. When the parts are assembled as shown and described, the replacement wheel 74 will be rotatable about the tubular sleeve 46 in one direction only such that the skate 10 is moveable in one direction only.

While the present invention has been described with respect to two embodiments, it will be appreciated that many modifications and variations may be made without departing from the true spirit and scope of the invention. It is therefore the intent of the following claims to cover all such variations and modifications which fall within the true spirit and scope of the invention.

What is claimed is:

1. A kit for modifying an inline skate having a first frame member and a second frame member parallel to and spaced from said first frame member, said first and said second frame members having opposing pairs of aligned holes therein with each of said opposing pairs of holes receiving an axle, said kit comprising a sleeve having an outer surface, a non-circular head at one end, and an inner opening sized to receive one of said axles, a locking plate at said one end of said sleeve and said locking plate having a non-circular hole therein for non-rotatably retaining said non-circular head against rotation with respect to said sleeve, and a wheel having a one-way clutch therein, said one-way clutch having an inner opening sized to engage said outer surface of said sleeve.

2. The kit of claim 1 wherein said locking plate comprises a surface for engaging a surface of said first frame member.

3. The kit of claim 1 wherein said locking plate comprises a shoulder for engaging a lower edge of said first frame member.

4. The kit of claim 1 wherein said locking plate comprises a hole for receiving a second axle.

5. A kit for modifying an inline skate having a first frame member and a second frame member parallel and spaced from said first frame member, said first frame member having a lower edge, said first and said second frame members having opposing pairs of aligned holes therein with each of said opposing pairs of holes having a removable axle extending therethrough, said kit comprising:

a tubular sleeve having an outer surface and a head at one end thereof, said head having a pair of opposing parallel outer surfaces, said tubular sleeve having an axial opening sized to receive one of said removable axles, a locking plate having an aperture therein, said aperture having inner surfaces spaced complementarily to said outer surfaces of said head of said replacement axle for non-rotatably retaining said head, said locking plate further having a means for engaging said skate for locking said locking plate against rotation with said wheel, and a wheel having a one-way clutch therein, said one-way clutch having an inner opening sized to engage said outer surface of said tubular sleeve.

* * * * *